United States Patent [19]

Rhodes et al.

[11] Patent Number: 4,469,584

[45] Date of Patent: Sep. 4, 1984

[54] PROCESS FOR PYROLYZING OIL-SHALE

[75] Inventors: Richard P. Rhodes, Westfield; Frank Hershkowitz, Cranford, both of N.J.; William N. Olmstead, New York, N.Y.

[73] Assignee: Exxon Research and Engineering Co., Florham Park, N.J.

[21] Appl. No.: 413,629

[22] Filed: Sep. 1, 1982

[51] Int. Cl.[3] ..... C10G 1/00; C10B 53/06; C10B 49/04

[52] U.S. Cl. ..... 208/11 R; 208/8 R; 201/31; 201/32

[58] Field of Search ..... 208/8 R, 11 R; 201/30, 201/31, 32

[56] References Cited

U.S. PATENT DOCUMENTS

| | | | |
|---|---|---|---|
| 1,814,463 | 7/1931 | Trent | 48/202 |
| 2,435,746 | 2/1948 | Jones | 201/29 |
| 2,694,035 | 11/1954 | Smith et al. | 208/11 R |
| 3,325,395 | 6/1967 | Ban | 201/32 X |
| 3,483,115 | 12/1969 | Haddad et al. | 201/32 X |
| 3,560,368 | 2/1971 | Rowland et al. | 201/32 X |
| 3,668,077 | 6/1972 | Ban | 201/32 X |
| 3,736,247 | 5/1973 | Jones et al. | 201/36 X |
| 3,972,801 | 8/1976 | Gregoli | 208/11 R |
| 4,003,820 | 1/1977 | Pelofsky et al. | 208/8 R |
| 4,039,427 | 8/1977 | Ban | 201/32 X |
| 4,058,905 | 11/1977 | Knight | 208/11 R X |
| 4,082,645 | 4/1978 | Knight et al. | 201/32 X |
| 4,125,437 | 11/1978 | Bacon | 201/44 |
| 4,133,741 | 1/1979 | Weichman et al. | 208/11 R |
| 4,211,632 | 7/1980 | Chukhanov et al. | 208/8 R |
| 4,405,438 | 9/1983 | Faulkner et al. | 208/11 R |

*Primary Examiner*—Delbert E. Gantz
*Assistant Examiner*—Glenn A. Caldarola
*Attorney, Agent, or Firm*—Henry E. Naylor

[57] ABSTRACT

Disclosed is a process for converting solid carbonaceous material, such as oil-shale, to a discriminate range of liquid and gaseous products, which process includes treating the carbonaceous material with an inert gas, at relatively short gas and long solids residence times in two or more temperature zones.

6 Claims, No Drawings

PROCESS FOR PYROLYZING OIL-SHALE

The present invention relates to an improved process for the pyrolysis of carbonaceous materials such as oil-shale, to selectively produce pyrolytic products.

Coal and oil-shale are growing in importance primarily because of the rapid depletion of known petroleum and natural gas reserves. Transition energy sources will be needed as a bridge between petroleum and the potentially unlimited energy sources of the future, such as solar power and nuclear fusion. Owing to their great abundance, coal and oil-shale are perceived as keystones of such a bridge. Consequently, much work is presently being done to provide economical ways of converting these materials to valuable liquid and gaseous products. Retorting and pyrolysis processes in which coal or oil-shale, with or without a diluent, is subjected to elevated temperatures and pressures to produce oil are well known.

The relatively high nitrogen content and relatively low hydrogen to carbon ratios of oil-shale liquids requires that relatively large amounts of hydrogen be used to hydrotreat such liquids to meet end use specifications. Such end use products include jet fuel and heating oil. Although various retorting and pyrolysis processes for oil-shale having met with various degrees of commercial success, there is still a need in the art for processes which will yield liquid streams having relatively low levels of heteroatoms, such as nitrogen, sulfur, and oxygen and which can be selectively produced to contain various levels of aromaticity.

By practice of the present invention coal and oil-shale may be pyrolyzed to obtain discriminated product streams, one or more of which is relatively low in heteroatom-containing compounds wherein the heteroatom is nitrogen, sulfur or oxygen. The product streams are also discriminated with respect to aromaticity.

SUMMARY OF THE INVENTION

In accordance with the present invention, there is provided a process for obtaining a discriminated range of liquid and gaseous products from carbonaceous materials selected from the group consisting of coal and oil-shale, which process comprises:

(a) feeding the carbonaceous material into a plug-flow type reactor, wherein the reactor contains two or more temperature zones with each temperature zone containing one or more stages;

(b) introducing an inert gas independently into each stage of each temperature zone in such a manner that the gas residence time in each stage is less than about 30 seconds, wherein the temperature of the inert gas introduced into each successive temperature zone is at a temperature which will cause each stage in each successive temperature zone to be at least about 25° C. higher than that of the stages of the immediately preceeding temperature zone and wherein the temperature of the gas introduced into the one or more stages of the first temperature zone is such that the temperature in that zone is in range of about 350° C. to about 450° C. and the temperature of the last temperature zone is no greater than about 700° C.; and (c) collecting the liquids and gases from each stage of each temperature zone.

In preferred embodiments of the present invention, the inert gas is nitrogen, the temperature in the first temperature zone is about 400° C., and the carbonaceous material is an oil-shale similar to those in the Green Riber formation in the Western United States.

DETAILED DESCRIPTION OF THE INVENTION

Any type of coal and oil-shale may be treated as the carbonaceous material according to the present invention.

It is preferred that the carbonaceous material have as high a surface area as possible; although, it is not economically justifiable to pulverize it to a very fine powder. Consequently, it is desirable to expose as much of the surface of the carbonaceous material as possible, without losing material as dust or fines, or as the economics of grinding or process equipment may dictate. Generally, for purposes of the present invention, the carbonaceous material will be ground to a relatively finely divided state and will contain a majority of particles less than about 4 mesh, U.S. Sieve Size. The carbonaceous material may be dried by conventional drying techniques, for example, heating to a temperature of about 100° to about 110° C.

The carbonaceous material, after grinding, is introduced into a plug flow reactor. The term "plug flow reactor", as used herein, means a reactor of such design that substantially all of the carbonaceous material introduced through the top of the reactor exits from the bottom of the reactor in a time period given by the volume of the reactor divided by the volumetric flow rate. There are various ways to achieve plug flow. One way is to employ a moving bed reactor of vertical design wherein the carbonaceous material is gravity fed at the top of the reactor and flowed downward through two or more temperature zones each containing one or more stages. The bottom of the reactor is constructed so that its circumference, or opening, is less than the circumference, or opening, of the main body of the reactor. Preferably, the bottom of the reactor is of an inverse conical shape wherein the flow thru is controlled by a rotating plug with pockets in its surface which can be adjusted to restrict the flow of carbonaceous material, by varying plug rotation speed, to a desired degree. Inert gas is introduced independently and transverse to the flow of carbonaceous material.

Another way of achieving plug flow is by using a series of well stirred reactors—such as fluid bed reactors. The fluid beds would be connected in series so that the carbonaceous material from one bed would flow into the next bed, etc. Each stage of each temperature zone could be comprised of a single fluid bed. To more nearly approximate a plug flow reactor, two or more fluid beds in series would be required for each stage. The reaction products from each stage would be collected and kept separate so that, if desired, chemically distinct products could be obtained from each stage. These reaction products can then be routed to processing and end use.

In either of the above described plug flow schemes, inert gas is independently passed through the temperature zones of the reactor at temperatures ranging from about 350° C. to about 700° C. such that the gas introduced into each successive temperature zone is at least 25° C. greater than that of the preceeding zone and the temperature of the gas entering the first temperature zone is about 350° C. to about 450° C. Each temperature zone is comprised of one or more stages wherein inert gas is introduced independently to each stage and reaction products may be independently collected from each stage. Of course, all stages in any given temperature zone will be at substantially the same temperature.

The number of temperature zones and stages in any given zone which is selected for the practice of the present invention is primarily a function of the number and quantity of distinct reaction products one wishes to collect during pyrolysis of the carbonaceous material. Furthermore, the temperature of the inert gas introduced into each temperature zone will primarily be a function of the type reaction product(s) one wishes to obtain from that zone as well as a function of the temperature of any preceeding zone.

As is evident from the above, by the judicious selection of: temperatures of the temperature zones, number of temperature zones and stages therein; and gas and solids residence times, one is able to obtain relatively high liquid yields and a discriminate selection of reaction products from the pyrolysis of carbonaceous material, such as coal and oil-shale.

In general, the process of the present invention comprises a pyrolysis process having a predetermined number of temperature zones wherein pyrolysis occurs over temperatures ranging from about 350° C. to about 700° C., preferably from temperatures ranging from about 400° C. to 600° C. The pyrolysis is performed in the presence of inert gas, preferably a substatially oxygen free flue gas at atmospheric pressure. The inert gas is passed through the carbonaceous material in such a way that separate discriminated product streams can be collected.

Plug flow type reactors are used in the practice of the present invention because they are capable of achieving both the short gas residence times and the long solids residences time required herein. In the practice of the present invention, the gas residence times will be less than about 30 seconds, preferably less than about 10 seconds. Total solids residence times will be from about 5 minutes to about 150 minutes, preferably from about 10 to 50 minutes. By choosing the proper residence times, substantially maximum conversion of carbonaceous material to liquids and gases is achieved and undesirable secondary reactions are minimized.

The following examples serve to more fully describe the manner of practicing the above-described invention, as well as to set forth the best modes contemplated for carrying out various aspects of the invention. It is understood that these examples in no way serve to limit the true scope of this invention, but rather, are presented for illustrative purposes.

EXAMPLE 1

Colorado oil-shale ground to 20/80 mesh, U.S. Sieve Size, and dried to less than 1% moisture content, was fed at a rate of 2.81 kilograms per hour into a dense-bed plug flow reactor having three temperature zones. Each temperature zone contained one stage, was capable of receiving an independent flow of nitrogen at elevated temperatures and was capable of independent removal of reaction products. The reactor was designed so that it was capable of achieving relatively short gas and long solids residence times.

Nitrogen gas, at an overall rate of 1.35 standard cubic feed per minute was divided into three equal streams wherein one stream was fed into the first temperature zone which was at 380° C., and the other nitrogen streams were fed independently into the other two temperature zones at a temperature of 520° C. and 555° C. respectively. The total pressure in the reactor was 2650 kpa.

By separately collecting the reaction products from each zone, product upgrading and ultimate product disposition is optimized.

Total oil yield from all zones was found to be 9.9 wt.% on dry oil-shale. The distribution of oil product among the zones was as follows:

Temperature Zone 1=6 wt.%
Temperature Zone 2=60 wt.%
Temperature Zone 3=34 wt.%

The distribution of oil yield for the temperature zones also takes into account a small amount of material which was collected in a fourth back-up vessel because of condenser inefficiencies. This material was distributed proportionately for each temperature zone.

Samples of oil from each of the three zones were analyzed for heteroatom content and carbon aromaticity. These data are shown in Table I below.

TABLE I

| | N % | S % | $^{13}C$ aromaticity % |
|---|---|---|---|
| Temp. Zone 1 | 1.42 | 0.99 | 26 |
| Temp. Zone 2 | 1.64 | 0.75 | 30 |
| Temp. Zone 3 | 2.26 | 0.50 | 35 |

The above data demonstrate that the products from the earlier temperature zones are lower in nitrogen and aromaticity, while the products from the later temperature zones are lower in sulfur content. The products from temperature zones one and two would be more useful for hydrotreating wherein the products from zone three would be suitable for use as a relatively low sulfur fuel oil.

EXAMPLE 2

Example 1 above was followed except the temperatures of the temperature zones were as follows: Zone 1=410° C., Zone 2=520° C., and Zone 3=570° C., and about 100 KPa pressure was employed.

Total oil yield from all three zones was found to be 11.4 wt.% on dry oil-shale. The distribution of oil product amont the zones was as follows:

Temperature Zone 1=47 wt.%
Temperature Zone 2=7 wt.%
Temperature Zone 3=46 wt.%

The distribution of oil yield for the temperature zones also takes into account a small amount of material which was collected in a fourth back-up vessel because of condenser inefficiencies. This material was distributed proportionately for each temperature zone.

Samples of oil from each of the product streams from each zone were analyzed for heteroatom content and hydrogen to carbon ratio. These data are shown in Table II below.

TABLE II

| | N % | S % | H/C ratio |
|---|---|---|---|
| Temp. Zone 1 | 1.39 | 0.88 | 1.63 |
| Temp. Zone 2 | 1.45 | 0.82 | 1.59 |
| Temp. Zone 3 | 1.88 | 0.60 | 1.56 |

Table II above further evidences that discriminate product streams obtained by the pyrolyzing oil-shale in accordance with the present invention. That is, a product stream lower in nitrogen content can be obtained from reaction zones at lower temperatures whereas product streams lower in sulfur content can be obtained from reaction zones at higher temperatures.

What is claimed is:

1. A process for converting solid carbonaceous material selected from the group consisting of coal and oil-shale to a discriminate range of liquid and gaseous products, which process comprises:

(a) feeding the carbonaceous material into a plug flow type reactor wherein the reactor contains two or more temperature zones with each temperature zone containing one or more stages and wherein the temperature of the carbonaceous material within each temperature zone is substantially constant;

(b) introducing an inert gas independently into each one or more stages of each temperature zone in such a manner that the gas residence time in each stage is less than about 30 seconds and the total solids residence time is from about 5 to 150 minutes, wherein the temperature of the inert gas introduced into each successive temperature zone is at a temperature which will cause each successive temperature zone to be at least 25° C. higher than the immediately preceding temperature zone and wherein the temperature of the gas introduced into the first temperature zone is such that the temperature in that zone is in the range of about 350° C. to about 450° C. and the temperature of the last temperature zone is less than about 700° C.; and (c) collecting the liquids and gases from each temperature zone separately.

2. The process of claim 1 wherein the carbonaceous material is oil-shale.

3. The process of claims 1 or 2 wherein the reactor contains 2 temperature zones and the temperature of the inert gas entering the first temperature zone is such that the temperature of the first zone is about 400° C., and the temperature of the inert gas entering the second temperature zone is such that the temperature of the second temperature zone is about 550° C.

4. The process of claim 3 wherein the plug flow type reactor is comprised of a series of fluid beds.

5. The process of claim 4 wherein the gas residence time for each stage is less than about 10 seconds and the overall solids residence time is from about 10 to 50 minutes.

6. A process for converting oil-shale to a discriminate range of liquid and gaseous products, which process comprises:

(a) feeding the oil-shale into a plug flow moving bed reactor containing two or more temperature zones with each temperature zone containing one or more stages wherein the temperature of the oil-shale within each temperature zone is substantially constant;

(b) introducing, a substantially oxygen free flue gas transverse to the flow of oil-shale and independently to each one or more stages, wherein the temperature of the gas introduced to the first temperature zone is such that the temperature of said first zone is from about 350° C. to about 450° C. and wherein the temperature of the gas introduced into each successive temperature zone is such that each successive temperature zone is at least 25° C. greater than that of the immediately preceding temperature zone and wherein the temperature zone of the last temperature zone is less than that about 700° C. and wherein the gas residence time for each stage is less than about 10 seconds and the overall oil-shale residence time is from about 10 to 50 minutes; and (c) collecting the liquids and gases from each temperature zone separately.

* * * * *